US006039298A

United States Patent [19]

Stier

[11] Patent Number: 6,039,298

[45] **Date of Patent: *Mar. 21, 2000**

[54] TAPERED STEEL POST

[76] Inventor: Peter Stier, 615 Highway 16 East, Spring Valley, Minn. 55975

[ * ] Notice: This patent issued on a continued prosecution application filed under 37 CFR 1.53(d), and is subject to the twenty year patent term provisions of 35 U.S.C. 154(a)(2).

[21] Appl. No.: 08/928,244

[22] Filed: Sep. 12, 1997

[51] Int. Cl.[7] ..... A45F 3/44

[52] U.S. Cl. ..... 248/545; 52/165; 248/156; 248/530

[58] Field of Search ..... 248/156, 523, 248/530, 508, 545; 52/165, 298

[56] References Cited

U.S. PATENT DOCUMENTS

| | | | |
|---|---|---|---|
| D. 29,550 | 10/1898 | Patterson | 52/165 X |
| 205,685 | 7/1878 | Romaine | 52/165 |
| 1,101,307 | 6/1914 | McDonough | 52/298 |
| 3,342,444 | 9/1967 | Nelson . | |
| 3,519,234 | 7/1970 | Matson . | |
| 4,156,332 | 5/1979 | Thompson | 52/165 |
| 4,235,034 | 11/1980 | Black . | |
| 4,271,646 | 6/1981 | Mils | 52/165 |
| 4,343,449 | 8/1982 | Osthus . | |
| 4,588,157 | 5/1986 | Mills . | |
| 4,874,149 | 10/1989 | Miceli . | |
| 4,923,164 | 5/1990 | Stenberg . | |
| 5,082,231 | 1/1992 | Knowles . | |
| 5,090,656 | 2/1992 | Brown . | |
| 5,123,623 | 6/1992 | McNamara . | |
| 5,709,366 | 1/1998 | Speece | 248/545 X |

*Primary Examiner*—Derek J. Berger
*Attorney, Agent, or Firm*—Haugen Law Firm PLLP

[57] ABSTRACT

A post support apparatus for retaining a mounting post in generally upright disposition and including an elongated support body which includes a lower stake portion adapted to be driven into the earth, and an upper or above-surface post receiving portion. The post receiving portion includes a cavity adapted to rigidly and clampingly retain the base of a post therewithin. The stake portion consists of a continuously tapered body of generally crisscross or "X" configuration, having outer edge surfaces therealong, and with a distal tip end for engaging the earth and a proximal end for above-surface post retention. The stake portion body is tapered continuously from its proximal end to its distal tip end so that the outer edge surfaces remain in firm contact with the subterranean earth or soil. The stake body is dual tapered along its length with the portion adjacent the distal tip being steeply angularly tapered. The post receiving portion comprises a pair of flanged right angle post receiving plates, one of which is welded to the proximal end of the stake portion body.

1 Claim, 4 Drawing Sheets

19
26
28
28
28
28
11
25
25A
21
34
17
18
23
24
32
30
30
31
20
36

TAPERED STEEL POST

BACKGROUND OF THE INVENTION

The present invention relates generally to an improved post support apparatus for retaining a mounting post or pole in a generally upright disposition relative to the earth, with the pole support comprising an elongated body including a stake portion at one end adapted to be driven into the earth and with a post-receiving portion at the opposed end which normally remains above the surface and which includes a cavity adapted to rigidly retain the base of a post therewithin. In particular, the present invention relates to such a post support or supporting apparatus in which the stake portion consists of a tapered body of generally "X" configuration with the body being tapered inwardly from the proximal end to the distal end. Such an arrangement provides for ease in driving the stake portion into the ground, while at the same time providing continuous contact between the outer edge surfaces of the stake and the earth, thereby providing a firm, durable, and steady mount.

In the past, a variety of devices have been designed and utilized for securing mounting posts in an upright position, and wherein the posts are supported by a stake portion driven into the earth or ground. Such devices are typically utilized in combination with posts for supporting mailboxes, newspaper receivers or receptacles, and other like items such as signs or placards, all of which normally remain in an elevated disposition relative to the surface of the earth. These support devices have frequently been in the form of angle irons, fence posts, or the like, all of which have a body with a typical regular rectangular configuration. As such, difficulties may be encountered during placement of the stake portion in the ground, due to contact with rocks, stones, buried debris or the like. The utilization of a tapered body generally provides for some ease in driving, however continued rigidity of the stake portion in the ground may pose some ongoing problems regarding rigidity.

SUMMARY OF THE INVENTION

In accordance with the present invention, however, the body of the stake portion of the support is continuously tapered from the proximal end toward the distal end, and that portion of the body closely adjacent the distal end is preferably tapered at a sharper angle to provide greater ease when starting to drive the stake portion into the earth or ground. Additionally, the distal tip end is preferably brought to a rather sharp or only slightly blunted end again to ease the initial driving operation.

In order to accommodate a variety of posts which may have modest dimensional or configurational differences, a support pad or plate is provided at the proximal end of the stake portion and a pair of flanged angle irons are mounted thereon so as to provide a square or rectangular cavity for receiving and rigidly mounting in place the desired post. A clamping means in the form of four individual bolts is provided in order to achieve appropriate clamping forces for the flanged angle irons to retain the post in place.

Therefore, it is a primary object of the present invention to provide an improved post support apparatus for retaining a mounting post in a generally upright disposition, wherein the support apparatus includes a stake portion which is tapered continuously from its proximal end toward its distal end for simplifying the stake driving operation, and at the same time providing a supporting apparatus which remains firmly in contact with the earth following the driving operation.

It is a further object of the present invention to provide an improved post support apparatus for retaining a mounting post in generally upright disposition relative to the surface of the earth, and wherein the apparatus includes an elongated body having a stake portion which is tapered continuously from its proximal end to its distal tip end.

It is a further object of the present invention to provide an improved post support apparatus which includes an elongated body having a stake portion which is adapted to be driven directly into the earth, and with the stake portion having a plate secured to its proximal end for mounting adjustable post-receiving plates thereon to form a cavity for rigidly receiving and retaining a post therein.

Other and further objects of the present invention will become apparent to those skilled in the art upon a study of the following specification, appended claims, and accompanying drawings.

IN THE DRAWINGS

DESCRIPTION OF THE PREFERRED EMBODIMENT

Figure 1:
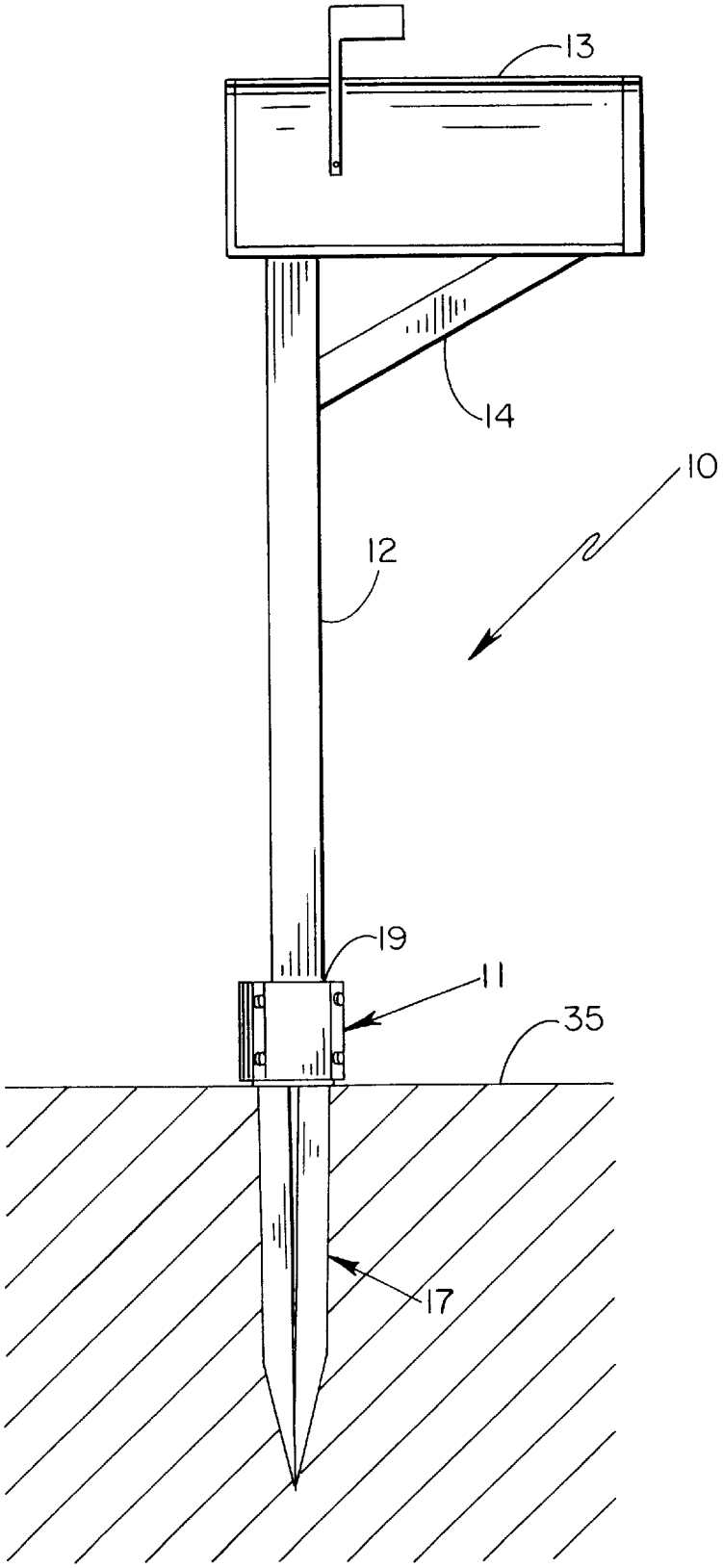
FIG. 1 is a side elevational view of the post supporting apparatus of the present invention, and illustrating the apparatus with the stake portion driven into the earth, with a conventional mail-receiving receptacle or mailbox at the upper end of the post, and with the earth being shown in section.
Figure 2:
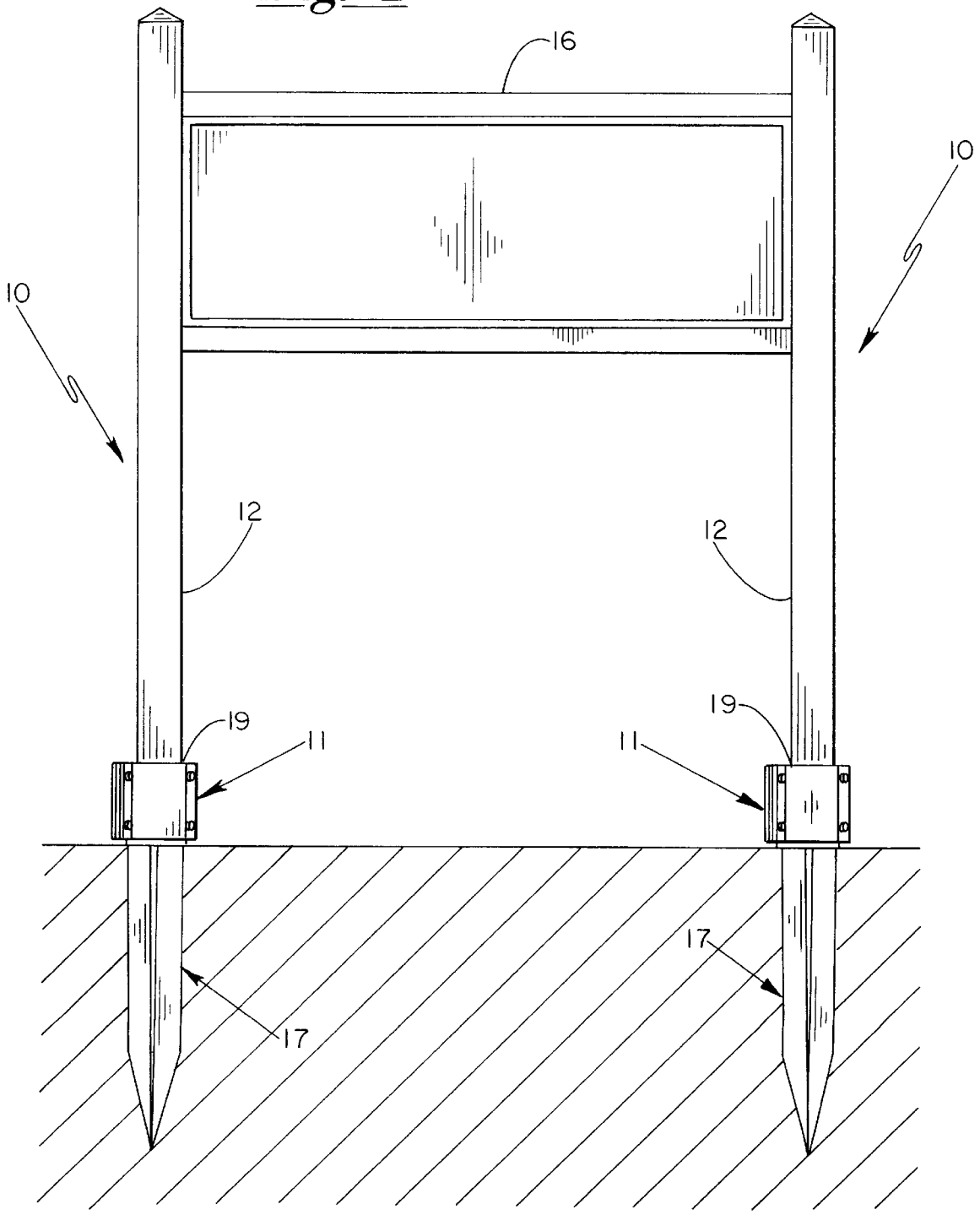
FIG. 2 is a view similar to FIG. 1 and illustrating a pair of post support in accordance with the present invention driven into the earth and aligned so as to support a sign or other placard therebetween.

With particular attention being directed to FIGS. 1 and 2 of the drawings, the post assembly generally designated 10 includes a post support apparatus shown generally at 11 which is adapted for retaining a mounting post 12 in generally upright disposition thereon. Post 12, in FIG. 1, supports a conventional mail-receiving receptacle or mailbox 13 supported by post 12 and bracket 14. FIG. 2, by way of example, illustrates a pair of post supporting apparatus 11, each supporting a post 12, with post 12 in turn supporting and retaining a sign or the like as at 16.

Figure 5:
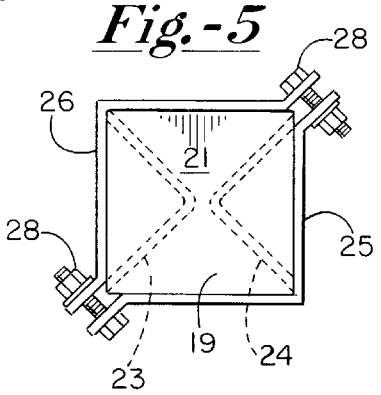
FIG. 5 is a top plan view of the apparatus illustrated in FIG. 4, and being taken along the line and in the direction of the arrows 5—5 of FIG. 4.
Figure 6:
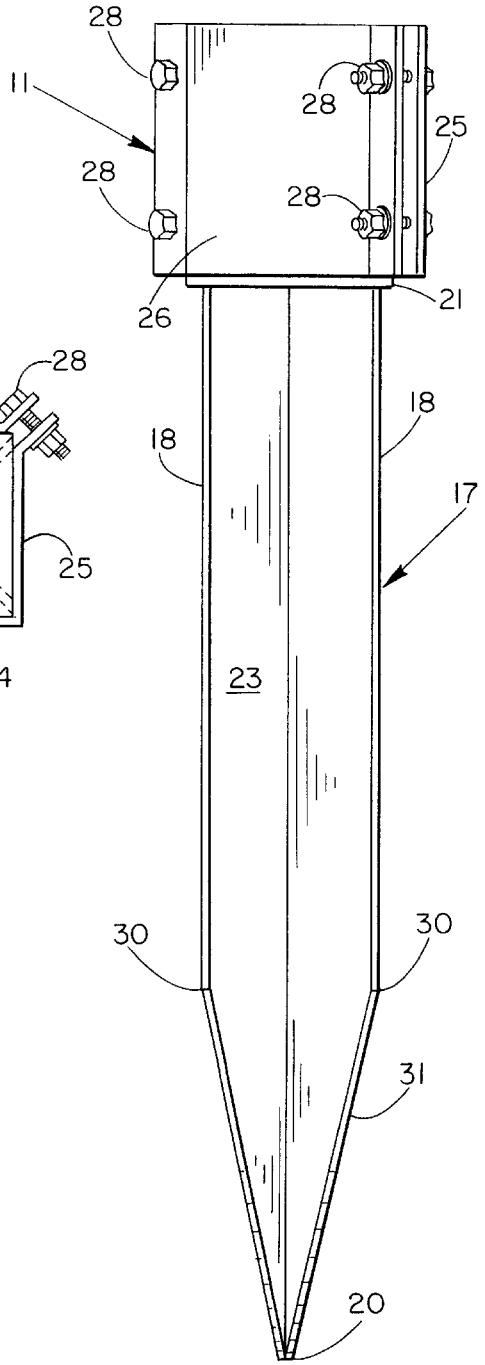
FIG. 6 is a side elevational view of the post support apparatus of the present invention.

As indicated in FIG. 1, post support apparatus 11 is in the form of an elongated support comprising a stake portion or body 17 at one end, and which is adapted to be driven into the earth as illustrated in FIGS. 1 and 2, with the earth being shown in section. A post-receiving portion or cavity as at 19 is provided at the opposed or proximal end, with cavity 19 being adapted to rigidly retain the base of a post such as post 12 therewithin. The stake portion 17 consists of a pair of angle irons 23 and 24 which together form a tapered body of generally 90-degree criss-cross or "X" configuration as shown in FIG. 5, with outer edge surfaces as shown at 18. Stake portion 17 terminates at a distal tip end 20 which is designed for initial engagement with the earth, and a proximal end having a plate 21 thereon. Plate 21 is utilized to support the bottom end of a post, with the plate 21 further supporting a pair of flanged right angle plates or post clamping members or plates 25 and 26.

Figure 3:
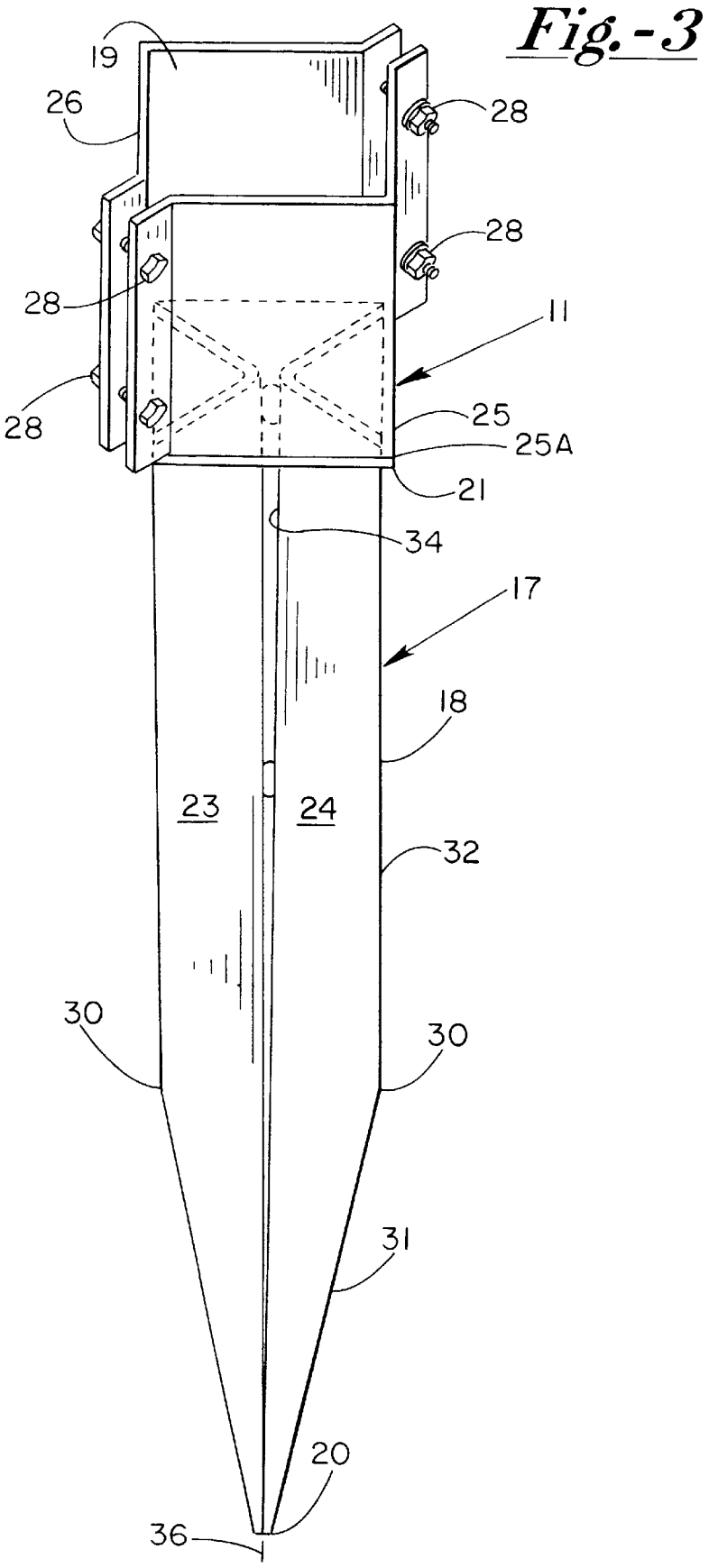
FIG. 3 is a perspective view of the post support apparatus of the present invention and illustrating the post-receiving cavity in partially open disposition.
Figure 4:
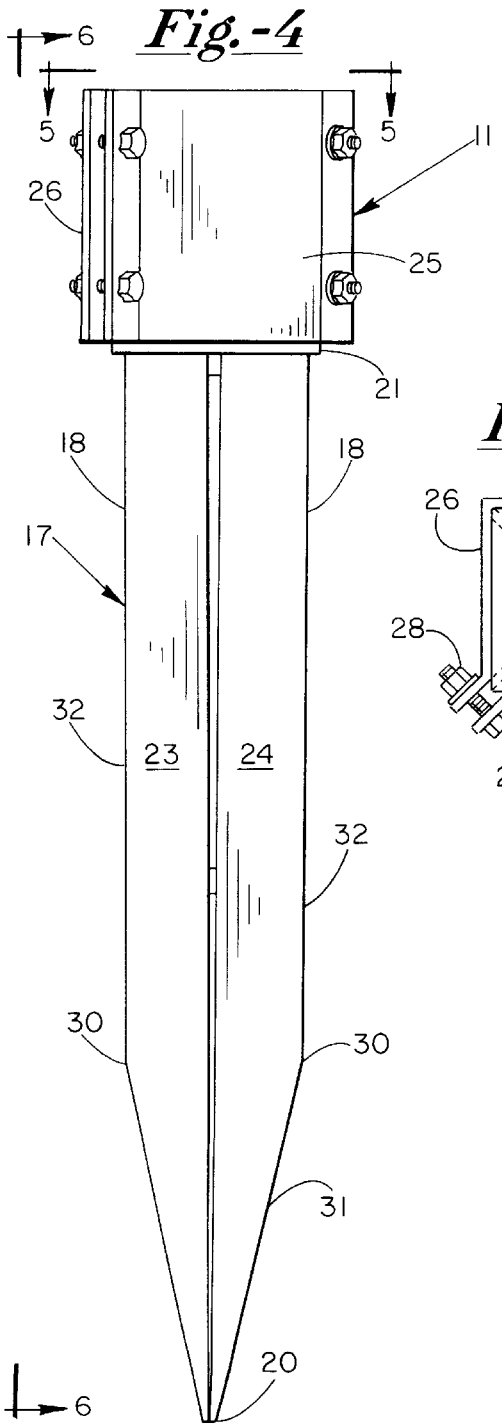
FIG. 4 is a front elevational view of the post support apparatus.

The stake portion 17 of the body is continuously tapered inwardly from the proximal end to the distal tip end so that the outer edge surfaces 18 remain in firm contact with the subterranean earth as the stake post body advances into and remains in the earth. The plates 25 and 26 are adapted to receive and clamp a post received therewithin. Clamping force is applied to the post receiving plates through bolts and nuts as shown at 28—28. In the embodiment as illustrated in FIG. 3, only flanged right angle plate 25 is welded at its bottom edge to plate 21, with the weld or bond being continuous along the contact line such as at 25A. Right angle plate 26 is not attached to plate 21, so that it is free to move relative to mating plate 25 under the force of bolts 28—28. Thus, motion of angular plate 26 under the force of bolts 28—28 toward fixed plate 25 provides the adjustable size cavity and clamping force necessary to secure post 12 in place.

As is indicated in the drawings, the body 17 is provided with a pair of tapers, with the tapers meeting at apex 30. A gradual tapered segment is provided along edge line 32 which is elevated from apex 30, while a relatively steep angular tapered portion or segment is defined along that portion beneath apex 30, such as at 31. Also, as indicated in FIG. 3, distal tip end 20 is substantially pointed, with the term "substantially pointed" referring to a configuration which may have some modest blunt features for safety purposes and for ease of manufacture.

In the device illustrated in the drawings, the length of stake portion 17 is preferably about 24 inches, and with this length, the gap or space between the pair of angle iron members 22 and 23 increases from actual contact at distal end 20 to a gap of one-quarter inch at the proximal end adjacent plate 21. This is the gradual taper of one-quarter inch in 24 inches, while the steep taper defined below apex 30 along edge 31 is generally at an angle of about 10 degrees from the central axis of stake portion 17. As is apparent in the drawings, the stake portion or body 17 comprises a pair of 90-degree angle iron legs secured together at their apices to form the dual taper configuration for post support apparatus 11. The term "iron" is employed in a mechanical sense, since other metals may be employed such as certain types of aluminum for certain soils.

In actual operation, the user will place a driving member in the form of a short length of post, for example, a length of 4"×4" stack into the cavity 19. Thereafter, through use of a sledge hammer or other driving device, the stake portion may be driven into the earth to the desired level, such as is illustrated in FIGS. 1 and 2, with the earth being shown in section as at 35. In this arrangement, the stake portion will be driven into the ground or earth generally along its axis 36 as shown in FIG. 3. Upon reaching the desired depth, the driver segment is removed and the base end of permanent post 12 is placed within cavity 19. The clamping bolts are then snugged up to rigidly retain post 12 in proper disposition within the post supporting apparatus, and the device is then ready for use.

It will be noted that the specific examples and illustrations given herein are for purposes of illustrating the preferred embodiment of the present invention and it will be understood that various departures may be made from the language of the following claims without departing from the spirit and scope of the present invention.

What is claimed is:

1. Post support apparatus for retaining a mounting post with a base portion and a shank portion in generally upright disposition and with said post support apparatus including an elongated support which comprises a stake portion at one end which is adapted to be driven into the earth and a post receiving portion at an opposed end including a cavity adapted to rigidly clampingly retain the base portion of the post therewithin; said post support apparatus being characterized in that:

(a) said stake portion comprises a continuously tapered body of generally "X" shaped cross-section with outer edge surfaces therealong, and with a distal tip end for engaging the earth and a proximal end having a plate thereon upon which said post receiving portion is attached;

(b) the body of said stake portion of the post support comprises a pair of 90-degree angle legs secured together along downwardly converging axes, with their mutual apices being joined at the distal tips thereof, and with their mutual apices being spaced apart at the proximal end to form said downwardly converging axes;

(c) said stake portion body thereby having a tapered configuration extending continuously from the proximal end to the distal tip end and wherein said stake portion is a dual tapered member provided with a gradually angularly tapered portion and a steeply angularly tapered tip portion, with the steeply angular tapered tip portion being formed adjacent the distal tip end, and with the distal tip terminating in a substantially pointed configuration, so that said outer edge surfaces of the pair of 90 degree angle legs including the surfaces of said apices remain in firm contact with the subterranean earth as the stake post body is advanced into the earth;

(d) wherein the gradually tapered portions of said stake portion and the disposition of said 90 degree angle legs forming said stake portion tapers at the rate of one-quarter inch for each 24 inches of length, and wherein said steeply angularly tapered segment is tapered at an angle of about 10 degrees from a plane normal to the axis of said stake; and (e) said post receiving portion comprising a pair of mating flanged right angled post receiving plate members, with the first of said pair of members being attachably secured along its bottom edge to the said opposed end of the stake portion, and with the second of said pair of members being adapted to be adjustably clampingly secured to said first member for securing said post receiving plates together about the base portion of said mounting post so as to conform the dimensions of said post receiving portion to said post to securely clamp and support said post in upright disposition therewithin.

* * * * *